US007866573B2

(12) United States Patent
Stenborg

(10) Patent No.: US 7,866,573 B2
(45) Date of Patent: Jan. 11, 2011

(54) ERGONOMIC SPRAY GUN

(75) Inventor: Eric Stenborg, New Brighton, MN (US)

(73) Assignee: GP Companies, Inc., Mendota Heights, MN (US)

( * ) Notice: Subject to any disclaimer, the term of this patent is extended or adjusted under 35 U.S.C. 154(b) by 399 days.

(21) Appl. No.: 12/217,957

(22) Filed: Jul. 10, 2008

(65) Prior Publication Data

US 2010/0006674 A1 Jan. 14, 2010

(51) Int. Cl.

| | |
|---|---|
| ***B05B 7/02*** | (2006.01) |
| ***B05B 9/01*** | (2006.01) |
| ***F23D 11/46*** | (2006.01) |
| ***F23D 14/60*** | (2006.01) |

(52) U.S. Cl. ..... 239/526; 239/525; 239/527; 239/569

(58) Field of Classification Search ..... 239/525–532, 239/569–586

See application file for complete search history.

(56) References Cited

U.S. PATENT DOCUMENTS

| | | | | |
|---|---|---|---|---|
| 1,524,283 | A * | 1/1925 | Beach | 239/415 |
| 2,079,933 | A * | 5/1937 | Fisher | 239/354 |
| 3,796,376 | A * | 3/1974 | Farnsteiner | 239/353 |
| 5,740,968 | A | 4/1998 | Mueller | 239/526 |
| 6,273,345 | B1 | 8/2001 | Kaligian, II et al. | 239/419.3 |
| 6,460,787 | B1 | 10/2002 | Hartle et al. | 239/691 |
| 7,028,925 | B2 | 4/2006 | Guest et al. | 239/526 |
| 7,083,120 | B2 | 8/2006 | Gilpatrick et al. | 239/397 |
| 7,083,124 | B2 | 8/2006 | Bednorz et al. | 239/526 |

* cited by examiner

*Primary Examiner*—Len Tran
*Assistant Examiner*—Justin Jonaitis
(74) *Attorney, Agent, or Firm*—Mark A. Litman & Associates, P.A.

(57) ABSTRACT

A fluid control spray gun stops, starts and controls flow of fluids through a nozzle. The gun has a fluid entry port; a trigger that controls fluid flow by movement of a pin; a handle that moves the trigger; a fulcrum point on the handle; three floating pins comprising in order a first floating pin, a second floating pin and a third floating pin, the three floating pins being present in an upper region of the handle; a hand grip portion in the handle; the upper region of the handle allowing engagement between the first floating pin and the trigger; and the upper region of the handle having a forward end allowing engagement of the third floating pin with a stabilizing element.

11 Claims, 4 Drawing Sheets

ERGONOMIC SPRAY GUN

BACKGROUND OF THE INVENTION

1. Field of the Invention

The present disclosure relates to a spray gun and, more specifically, a spray with an ergonomic design that still allows automatic shut off when a handle is released, even accidentally.

2. Background of the Art

Such spray guns are customarily operated by a liquid medium under high pressure. Work with spray guns is characterized by high physical stress for the operator as a result of the high holding and recoil forces. In addition, a high risk potential is created by the rebounding of material and the high energy content of the liquid jet, such as a water jet. On the one hand, this requires a construction with a good ergonomic design and the highest safety standard and, on the other hand, that only correspondingly instructed personnel trained for the work with high-pressure water jets are permitted to work with spray guns. Additionally, if spray guns are accidentally dropped, the high pressure spray must be automatically turned off to prevent the spray gun (and any associated tubing) from whipping about and causing injury and damage.

Mechanical lever systems generally require the application of an operating or holding force by the operator In this case, the operator's hand must necessarily always remain in contact with the lever. During a fairly long switch-on period, this leads to fatigue or even to cramps in the switching hands. As a result, safety-critical situations may arise; for example, because of the fact that the switch-off cannot take place or can only take place in a delayed manner. It is known from practice that, because of the strained working position, the operating personnel frequently fixes the lever devices by simple means, such as wooden wedges, wire or adhesive tape, against safety regulations, in order to reduce the holding force.

Complex systems of electronic off-on controls are known using contactless electronic proximity sensors. The sensor converts a physical quantity to an electric signal and utilizes its change for generating a switching function. Here, the influencing element, which the operator utilizes for the switching, is of a passive nature in that no communication takes place between the operating element and the proximity sensor. This results in the disadvantage of this state of the art that the system can easily be disturbed or even unintentionally switched as a result of outside influences, such as magnetic or electric fields, vibrations or temperatures. The device is also relatively expensive, and electronic failure might be catastrophic.

U.S. Pat. No. 7,083,124 (Bednorz et al.) describes an ergonomic handle for a spray gun that has contactless actuation of the spray gun without moving parts takes place by an active system which is distinguished by the fact that the actuating element, preferably a transponder, communicates with a reading station of an electronic evaluating device within the spray gun. The transponder is a microelectronic circuit with a transmitting and receiving antenna, a control logic and a fixedly stored safety code as well as an energy accumulator which provides the energy for the return of the safety code. The transponder receives energy packets pulsed at regular intervals from the reading unit of the spray gun and returns information. This takes place by way of antennas in the handle tube which are arranged in pairs in order to generate a concentric field without pole points so that a uniform defined switching interval is ensured.

U.S. Pat. No. 5,740,968 (Mueller) describes a high pressure industrial washdown gun. The gun comprises a body having a hand grip portion, a trigger, a flow control valving system and a conduit for directing the water to the interior of the gun body. The valving system includes a containment sleeve, a connector, a nozzle assembly, a valving rod, and a central water flow passage extending therethrough. A tapered seat surrounds the flow passage. The valving rod includes a nose portion, an enlarged diameter head, and an elongated stem. The valving rod slides within a guide which positions it relative to the containment sleeve. A return spring is provided for the valving rod. A locking mechanism is provided for the handle.

High pressure systems with which the handle may be associated are well known in the art such as those disclosed in U.S. Pat. Nos. 7,083,120; 7,028,925; 6,460,787; 6,273,345; and the like.

Alternative systems are still necessary, especially if those systems can meet the functional, ergonomic and safety needs of the industry.

SUMMARY OF THE INVENTION

A fluid control spray gun stops, starts and controls flow of fluids through a nozzle. The gun has:

a fluid entry port;

a trigger that controls start and stop of fluid flow by movement of the pin;

a handle that moves the trigger;

a fulcrum point on the handle around which the handle moves;

three floating pins comprising a first floating pin proximal to the trigger, a second floating pin and a third floating pin distal to the trigger, the three floating pins being present in an upper region of the handle;

a hand grip portion in a lower region of the handle;

the upper region of the handle having a rearward end allowing engagement between the first floating pin and the trigger; and the upper region of the handle having a forward end allowing engagement of the third floating pin with a stabilizing element. When fluid flow is stopped by the spray gun, the third floating pin is not engaged with the stabilizing element and when the fluid flow is fully opened by the spray gun, the third floating pin is engaged with the stabilizing element and the three floating pins are approximately in line with the trigger.

DETAILED DESCRIPTION OF THE INVENTION

Figure 1:
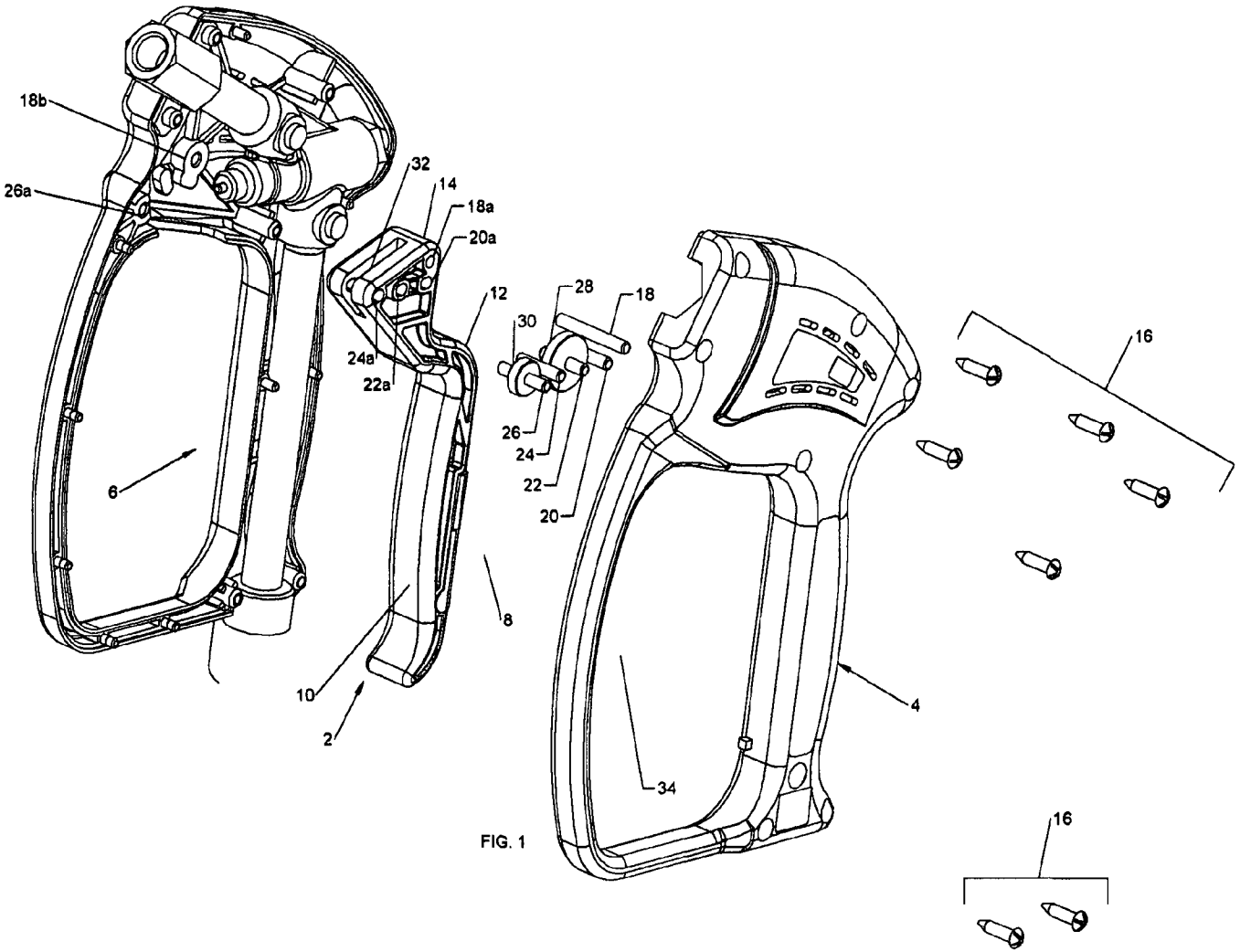
FIG. 1 shows an exploded view of a spray device enabled and described herein.

The present technology enabled described and claimed herein comprises an ergonomic handle for a hand controlled system. The system may provide power (e.g., an electrically powered device in which the handle movement moderates, opens, closes or adjusts power provided) or fluids (gas or liquids) through a pumping or spraying or other application system. Although a hand held spray system is preferred, there are other ergonomic and safety benefits in the other types of systems used. For example, in the handle/hose systems used for pumping gasoline into vehicles, there is often a locking device in which the gasoline flow is locked into a certain rate and the rise of gasoline in the tube leading to the tank will automatically shut of the gasoline flow when a particular level is reached. One problem that has occurred with these systems is that users will lock the device while it is inserted into the vehicle and leave it unattended. Wind or accidental bumping or vibrations may dislodge the handle from the vehicle and gasoline can continue to spill. The present handle is preferably designed without a locking element, while at the same time it ergonomically reduces stress on hands for the user, yet will still automatically shut off when the handle is released. In the absence of a locking element, as is the preferred embodiment, the user cannot walk away from the gas pump. This is a significant benefit as many jurisdictional regulations, ordinances and laws actually prohibit gasoline pump users from leaving the immediate area of the pump handle during use.

The actual system and device of the present disclosure includes a stabilizing system that stabilizes a handle trigger on a hand-operated control. The hand-operated control will have a handle trigger that is squeezed or pulled or operated by a grip of a user and a system of pins that will align with a control (power or volume control or rate control) trigger, at least one floating pin and at least one load-bearing pin. Preferably the system will have a handle trigger (or grip handle trigger) that is squeezed or pulled or operated by a grip of a user and a system of pins that will align with a control trigger, at least two floating pins and at least one load-bearing pin. More preferably, the system will have a handle trigger that is squeezed or pulled or operated by a grip of a user and a system of pins that will align with a control trigger, at least three floating pins and at least one load-bearing pin. The floating pins will have their movement controlled by rotation of a top portion (head) of the grip handle (comprising a grip handle trigger, and connecting neck and a head) so that when the grip handle is pulled as far back as a grip force can pull the handle, the alignment of the control trigger and the floating pins and the stabilizing pins will reduce, moderate or even stabilize the release forces acting on the control trigger to stop or reduce output through the handle control. Preferably, when the grip handle is pulled as far back as a grip force can pull the handle, the release forces will be minimized, yet remain sufficiently functional to shut off the flow (power or material) through the handle when gripping pressure is removed.

A non-limiting embodiment of the invention fluid control spray gun for stopping, starting and controlling flow of power or material (especially fluids) through a manually gripped system. One embodiment of the system shown with a handle and nozzle for fluid exit (e.g., in a spray system) could have:

a fluid entry port;

a control trigger that controls start and stop of fluid flow by movement of the control trigger;

a grip handle that moves the control trigger;

a fulcrum point on the grip handle around which the handle moves;

at least one and preferably three floating pins comprising at least a first floating pin proximal to the trigger, a second optional but preferred floating pin and a third optional and most preferred floating pin distal to the trigger, the at least one and preferably two or three floating pins being present in an upper region of the handle (referred to herein as the head);

a hand grip portion in a lower region of the grip handle;

the head of the grip handle having a rearward end allowing engagement between the first floating pin and the trigger;

the upper region of the handle having a forward end allowing engagement of a floating pin and preferably the third floating pin with a stabilizing element; wherein when fluid flow is stopped by the spray gun, no floating pin and preferably not the third floating pin is engaged with the stabilizing element, and when the fluid flow is fully opened by the spray gun, the most distal (from the control trigger) floating pin, which is preferably the third floating pin is engaged with the stabilizing element and the control trigger and at least one floating pin (and preferably the three floating pins) are approximately in line with the control trigger and the most distal floating pin is provides a load or force against the load bearing pin, which reduces release forces in the grip handle, which release forces act to oppose any gripping action on the grip handle or grip trigger.

These and other aspects of the present technology will be further explained and described in a review of the Figures.

FIG. 1 shows an exploded view of a handle control device 2, illustrated as a spray device enabled and described herein. The handle control device 2 has a left side frame 4, a right side frame 6 and a grip handle or control handle 8. The grip handle 8 has a grip trigger 10, a neck 12 and a head 14. The left side frame 4 and right side frame 6 are secured together with securing elements 16, here shown as screws. The grip handle 8 is secured between the left side frame 4 and right side frame 6. The head 14 of the grip handle is secured between the left side frame 4 and right side frame 6 at least by a fulcrum, shown as fulcrum pin 18 which fits into receiving hole 18*a* in the head 14 of the grip handle 8 and a further receiving hole 18*b* in the right side frame 6 of the control device 2. There is also a second further receiving hole (not shown) in the left side frame 4 of the control device 2. When the grip trigger 10 is pulled by a manual grip, the grip handle 8 rotates about the fulcrum pin 18. The head 14 also rotates about the fulcrum pin 18, but a smaller linear distance than does the grip trigger 10. Floating pins 20, 22 and 24 also rotate about the fulcrum pin 18 as does a receiving groove 32 in the front of the head 14. A natural orientation (when no pressure is applied to the grip handle 10) of the floating pins 20, 22 and 24 is at an angle (formed by an approximate line passing through the three floating pins 20, 22 and 24) elevated slightly above the center of the load-bearing pin 26. When there is a forced orientation (when significant pressure is applied to the grip handle 10) of the floating pins 20, 22, and 24, the pins are at an angle (formed by an approximate line passing through the three floating pins 20, 22 and 24) elevated less slightly above or at the center of the load-bearing pin 26, but not below the center of the load-bearing pin 26. The front of the head 14 moves downwardly when the grip trigger 8 is gripped. This motion brings the groove 32 into alignment and surrounding relationship with the toothless gearing extension 30 that is over the load-bearing pin 26. This toothless gearing extension 30 engages the most distal floating pin 24 which is exposed to the toothless gearing cover 30 through the groove 30. This engagement of the toothless gearing cover 30 and the load-bearing pin 26 is done by friction and tension between the toothless gearing cover 30 and the load-bearing pin 26. The grip trigger 10 is exposed for manual gripping through opening 34 formed in the two side frames 4 and 6.

Figure 2:
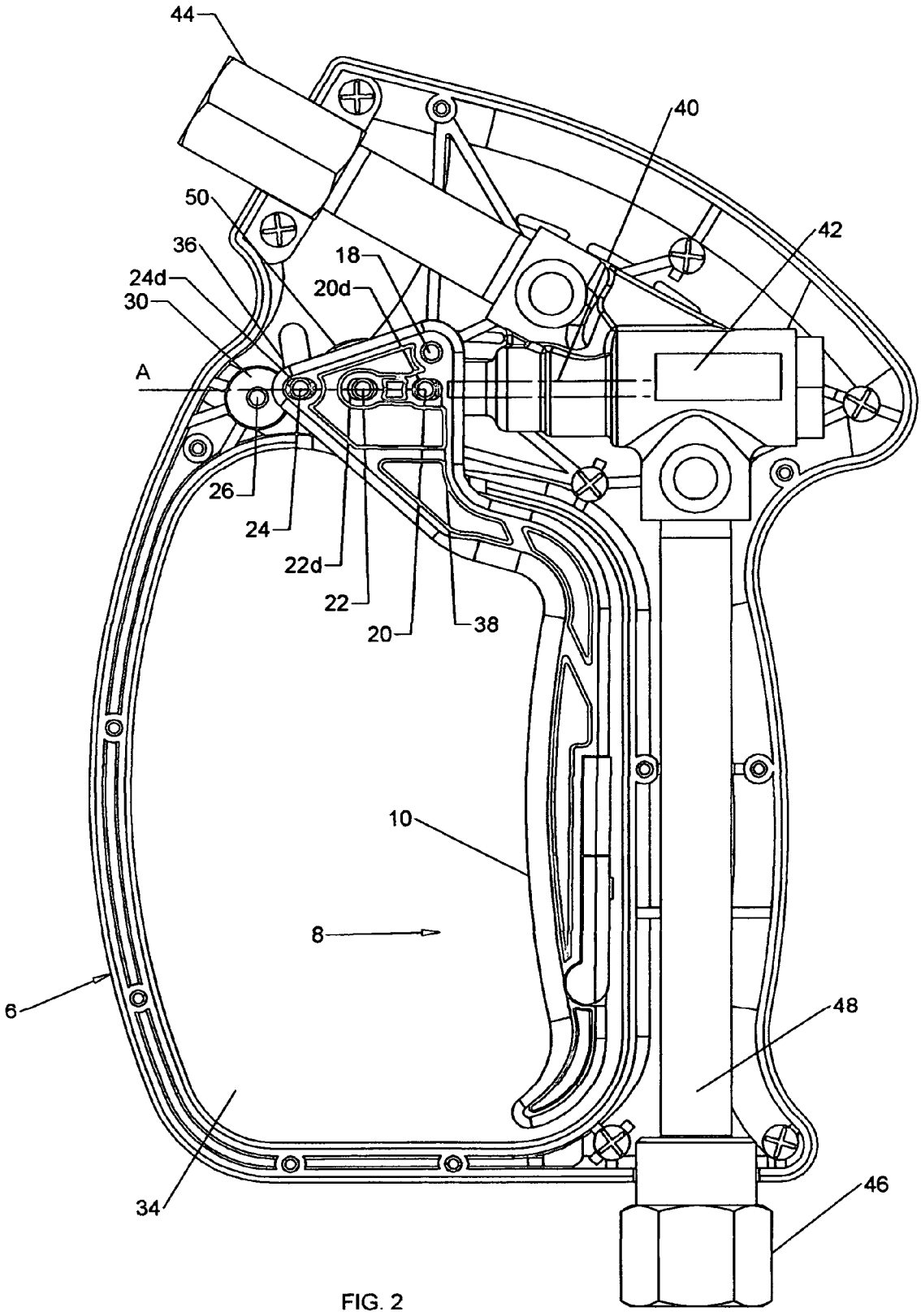
FIG. 2 shows a cutaway view of a spray device enabled and described herein.

FIG. 2 shows a cutaway view of a spray device 2 enabled and described herein with a view of the right hand side 6 exposed. The opening 34 is shown with the grip handle 8 and the grip trigger 10 in a compressed or gripped position. The three floating pins 20, 22 and 24 are shown in approximate alignment (as they float, they can shift so they may not be in perfect alignment) and the line A formed by the three floating pins 20, 22 and 24 is shown slightly elevated above the load-bearing pin 26. Each floating pin 20, 22 and 24 is within a corresponding hole 20*d*, 22*d* and 24*d* and each hole is large enough (especially along the direction of line A to allow the pins to float along line A. A second floating pin 22 is shown with an extension cover 50 which is another toothless extension of the second floating pin 22 that engages (by friction and force) with both floating pins 20 and 24 in this embodiment. The pins 20, 22 and 24 are designed to float to enable them to move easily when tension and forces bring them into contact with each other and the toothless gearing cover 30 (with floating pin 24) and a control trigger 40 that engages any flow control or power control system generically illustrated as 42, which may be valves, rheostats, switches, and the like without limitation. In FIG. 2, the flow control system 42 comprises valves that adjust flow of water entering inlet 46, flowing through pipe 48 and exiting through outlet 44. As will be described in greater detail later, when the device is in a stabilized position after gripping of the handle grip 10, the control trigger 42 has an end 38 (shown within opening 20*d*) that presses against floating pin 20, which floating pin 20 is in contact with the toothless gearing cover 50 of the second floating pin 22, and the toothless gearing cover 50 of the second floating pin 22 is in contact with the third floating pin 24 and the third floating pin 24 then contacts the surface of the toothless gearing cover 30 of the load-bearing pin 26. As the three floating pins and the control trigger 40 are in alignment, the tension between all three elements places surface tension against of the toothless gearing cover 30 of the load-bearing pin 26. This surface tension allows the tension on the grip 8 to be reduced, while maintaining stability in the grip 8 position, yet without locking of the grip 8 into position. Any locking effect is avoided because the line A is above the center of the load-bearing pin, and friction between the toothless gear cover 30 of the load-bearing pin and the third floating pin 24 is not sufficient to lock the relative position of the moving elements. If line A were allowed to pass below the center of the load-bearing pin 30, then there would be a locking effect if there were no spring or forces provided against the control pin (in a forward direction) that would overcome the inertia, friction and tension between the third floating pin 24 and the toothless gear cover 30 of the load-bearing pin 26.

Figure 3:
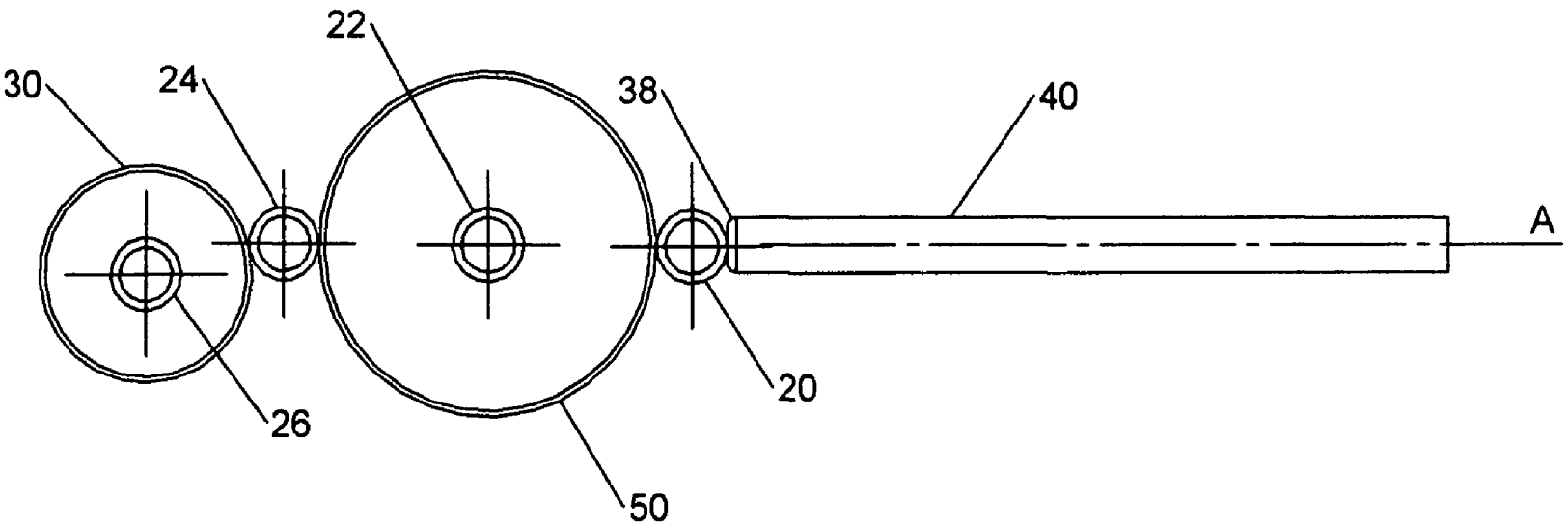
FIG. 3 shows a preferred alignment of a stabilizing system in a spray device enabled and described herein.

FIG. 3 shows a preferred alignment of a stabilizing system in a spray device 2 enabled and described herein. FIG. 3 clearly shows the control trigger 40 and the end of the control trigger 38 in contact with a first floating pin 20. The first floating pin 20 is in contact with the toothless gearing cover 50 surrounding floating pin 22. the toothless gearing cover 50 surrounding floating pin 22 is in contact with the third floating pin 24, which finally is in contact with the toothless gearing cover 30 surrounding load-bearing pin 26. The tension along line A of the control trigger 40, the three floating pins 20, 22 and 24 and the surface contact of the toothless gear cover 30 with the final (e.g., third) floating pin 24 provides sufficient stability to the alignment that gripping forces in the handle 2 (shown in FIGS. 1 and 2) are reduced, and tension in the user's hand can be reduced.

Figure 4:
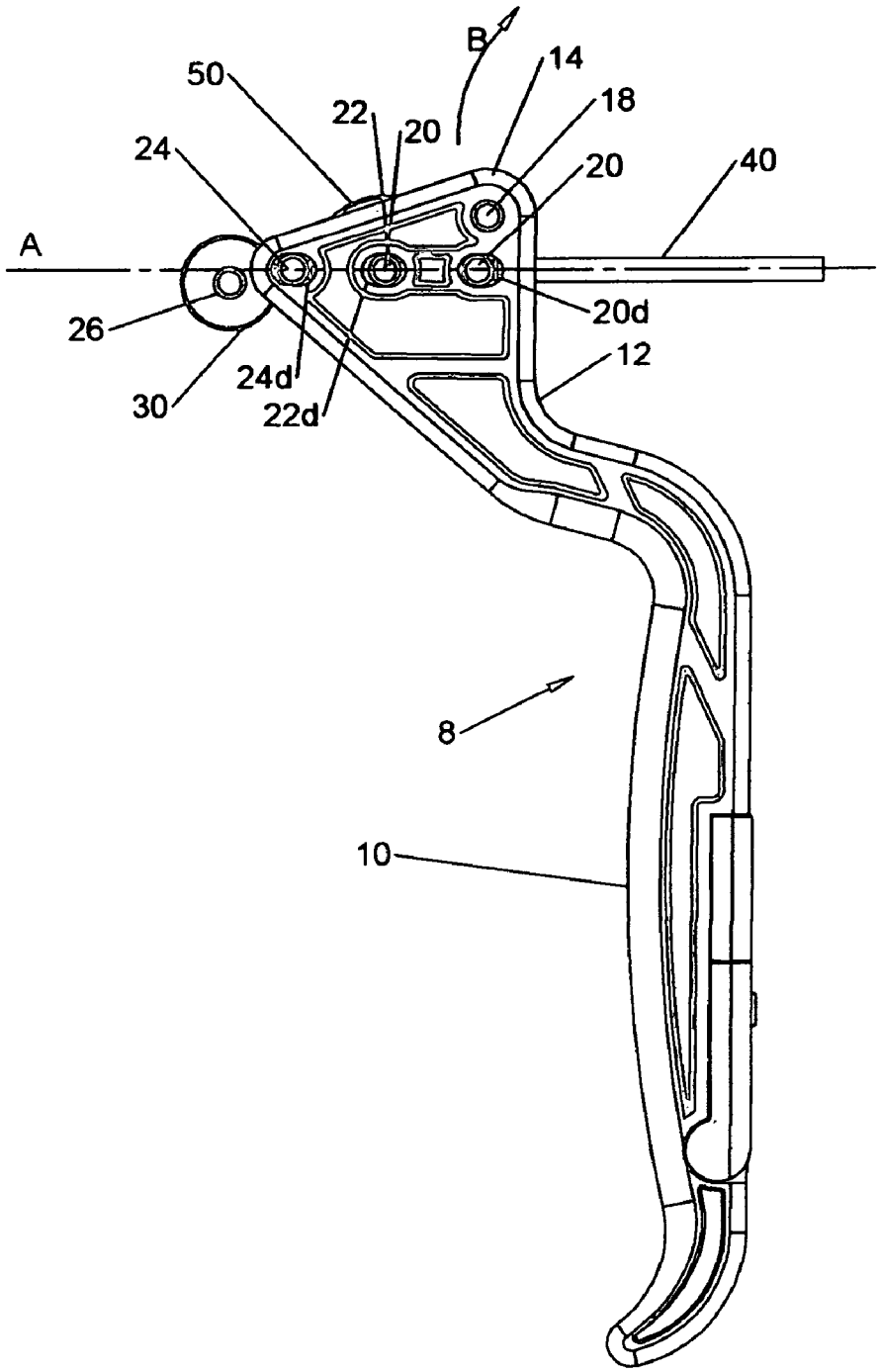
FIG. 4 shows a handle useful in a preferred alignment of a stabilizing system in a spray device enabled and described herein.

FIG. 4 shows a handle 8 useful in a preferred alignment of a stabilizing system in a spray device enabled and described herein. All numbers in FIG. 4 have the same meaning and represent the same elements as the numbers in previous examples. It can be seen that as the head 14 rotates along arc B, the third floating pin 24 will disengage from the load-bearing pin 26, and that the tension among the trigger control 40 and the three floating pins 20, 22 and 24 will relax, as the floating pins are then able to float within respective openings 20*d*, 22*d* and 24*d*.

The structure of the frame for the handle and the parts may be selected based upon structural requirements (e.g., strength, water or chemical resistance) and cost, with polymeric frames and metal pins and fulcrums being preferred.

Although specific elements, materials, and compositions may be described in the present disclosure, these descriptions are intended to be species supportive of generic concepts and are not intended to be limits on the scope of interpretation of the specification or claims. One skilled in the art can appreciate the alternatives and equivalents to the terms used in the description.

What is claimed:

1. A fluid control spray gun for stopping, starting and controlling flow of fluids through a nozzle comprising:

a fluid entry port;

a flow control system that controls start and stop of fluid flow by movement of a trigger;

a handle that moves the trigger;

a fulcrum point on the handle around which the handle moves;

three floating pins comprising a first floating pin proximal to the trigger, a second floating pin which acts as a stabilizing element and a third floating pin distal to the trigger, the three floating pins being present in an upper region of the handle;

a hand grip portion in a lower region of the handle;

the upper region of the handle having a reward end allowing engagement between the first floating pin and the trigger;

the upper region of the handle having a forward end allowing engagement of the third floating pin with the stabilizing element;

wherein when fluid flow is stopped by the spray gun, the third floating pin is not engaged with the stabilizing element and when the fluid flow is fully opened by the spray gun, the third floating pin is engaged with the stabilizing element and the three floating pins are approximately in line with the trigger.

2. A grip actuated hand control device that controls the rate of flow or level of power comprising:

a flow control system that controls said rate or said level by movement of a trigger;

a handle that moves the trigger;

a fulcrum point on the handle around which the handle moves;

three floating pins comprising a first floating pin proximal to the trigger, a second floating pin which acts as a stabilizing element and a third floating pin distal to the trigger, the three floating pins being present in an upper region of the handle;

a hand grip portion in a lower region of the handle;

the upper region of the handle having a rearward end allowing engagement between the first floating pin and the trigger;

the upper region of the handle having a forward end allowing engagement of the third floating pin with the stabilizing element;

wherein when flow or power is stopped by the control device, the third floating pin is not engaged with the stabilizing element and when the fluid flow is fully opened by the control device, the third floating pin is engaged with the stabilizing element and the three floating pins are approximately in line with the trigger.

3. The fluid control spray gun of claim 1 wherein the stabilizing pin has an extended annular cover thereon.

4. The fluid control device of claim 1 wherein a groove is present in the upper region of the handle and the groove is open to expose the third floating pin to enable contact of the third floating pin to the stabilizing pin.

5. The fluid control device of claim 3 wherein a groove is present in the upper region of the handle and the groove is open to expose third floating pin to enable contact of the third floating pin to the stabilizing pin in order to engage the extended annular cover on the stabilizing pin.

6. The fluid control device of claim 5 wherein the floating pin engages the extended annular cover of the stabilizing pin by friction contact along a cylindrical surface of the third floating pin.

7. A fluid control spray gun for stopping, starting and controlling flow of fluids through a nozzle comprising:

a fluid entry port;

a flow control system that controls start and stop of fluid flow by movement of a trigger;

a handle that moves the trigger;

a fulcrum point on the handle around which the handle moves;

at least one floating pin proximal to the trigger and moveable with respect to a load-bearing pin, the at least one floating pin being present in an upper region of the handle;

a hand grip portion in a lower region of the handle;

the upper region of the handle having a rearward end allowing engagement between the at least one floating pin and the trigger;

the upper region of the handle having a forward end allowing engagement of an at least one second floating pin acting as a stabilizing element;

at least one third floating pin;

wherein when fluid flow is stopped by the flow control system, the at least one third floating pin is not engaged with the at least one stabilizing element and when the fluid flow is fully opened by the flow control system, the at least one third floating pin is engaged with the at least one stabilizing element, and the at least one first floating pin, the at least one second floating pin, and the at least one third floating pin are approximately in line with the trigger.

8. The fluid control spray gun of claim 7 wherein the at least one stabilizing element has an extended annular cover thereon.

9. The fluid control device of claim 7 wherein a groove is present in the upper region of the handle and the groove is open to expose the at least one third floating pin to enable contact of the at least one third floating pin to the second floating pin.

10. The fluid control device of claim 8 wherein a groove is present in the upper region of the handle and the groove is open to expose the at least third floating pin to enable contact of the at least one third floating pin to the extended annular cover in order to engage the at least one second floating pin.

11. The fluid control device of claim 10 wherein the vice of claim 10 wherein the at least one third floating pin engages the extended annular cover of the second floating pin by friction contact along a cylindrical surface of the third floating pin.

* * * * *